United States Patent [19]

Stauffer et al.

[11] Patent Number: 4,849,118

[45] Date of Patent: Jul. 18, 1989

[54] CHLORINE-FREE SILVER PROTECTIVE LUBRICANT COMPOSITION (III)

[75] Inventors: Richard D. Stauffer, St. Charles; Jerry L. Thompson, Wheaton; Steven E. Lindberg, Naperville, all of Ill.

[73] Assignee: Amoco Corporation, Chicago, Ill.

[21] Appl. No.: 103,184

[22] Filed: Sep. 30, 1987

[51] Int. Cl.[4] ..... C10M 105/72; C10M 105/08

[52] U.S. Cl. ..... 252/47; 252/30; 252/48.2; 252/48.6

[58] Field of Search ..... 252/47, 45, 47.5, 39, 252/48.2, 48.6, 56 R

[56] References Cited

U.S. PATENT DOCUMENTS

| | | | |
|---|---|---|---|
| 2,719,125 | 9/1955 | Roberts | 252/47 |
| 2,749,311 | 6/1956 | Sabol | 252/47 |
| 2,764,547 | 9/1956 | Fields | 252/47 |
| 3,775,321 | 11/1973 | Turnquest | 252/47 |
| 3,909,420 | 9/1975 | Turnquest | 252/47 |
| 3,966,623 | 6/1976 | Krug | 252/47 |
| 3,969,235 | 7/1976 | Sung et al. | 252/42.7 |
| 4,136,043 | 1/1979 | Davis | 252/47.5 |
| 4,171,269 | 10/1979 | Zoleski | 252/33 |
| 4,609,480 | 9/1986 | Hata | 252/47 |

FOREIGN PATENT DOCUMENTS

| | | | |
|---|---|---|---|
| 2742359 | 9/1977 | Fed. Rep. of Germany | 252/47 |
| WO86/06092 | 10/1986 | PCT Int'l Appl. . | |
| 0816237 | 7/1959 | United Kingdom | 252/47 |
| 1428656 | 3/1976 | United Kingdom | 252/47 |

*Primary Examiner*—William R. Dixon, Jr.
*Assistant Examiner*—James M. Hunter, Jr.
*Attorney, Agent, or Firm*—Matthew R. Hooper; William H. Magidson; Ralph C. Medhurst

[57] ABSTRACT

Silver protective lubricant compositions essentially free of chlorine and zinc-containing compounds comprise a 1,3,4-thiadiazole, an overbased detergent and an ashless dispersant. The invention is also directed to a method of silver protection in engines which utilizes the above lubricant composition.

16 Claims, No Drawings

CHLORINE-FREE SILVER PROTECTIVE LUBRICANT COMPOSITION (III)

BACKGROUND OF THE INVENTION

1. Field of the Invention

The present invention relates generally to lubricant compositions useful in medium speed diesel engines such as commonly found in railroad locomotives, marine towboats and stationary power applications. These engines frequently have silver bearings which necessitate high TBN lubricant compositions incorporating specialized silver protective agents to protect against wear, extreme pressure and corrosion of silver parts. However, it is well known that zinc-containing wear agents such as the zinc dihydrocarbyldithiophosphates (typically used in passenger cars) cannot be used for this purpose given their incompatibility with silver bearings. Although chlorine-containing silver lubricity agents have been used for silver protection, it is desirable to find alternatives to such chlorinated materials. Thus, the present invention, more particularly, is directed to a lubricating composition having a TBN (total base number) of at least 7 and preferably in the range of from about 10 to about 30, essentially free of zinc-containing wear inhibitors and chlorine-containing silver lubricity agents comprising a major proportion of an oil of lubricating viscosity and a minor amount of (1) a thiadiazole compound having the general formula:

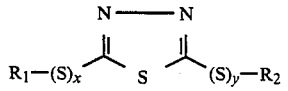

where x and y (the same or different) are integers from 1 to 5 and $R_1$ and $R_2$ (the same or different) are H or $C_1$ to $C_{50}$ hydrocarbyl; (2) and overbased detergent, preferably at least one selected from the group consisting of overbased alkali and alkaline earth metal sulfonates, phenates and salicylates; and (3) an ashless dispersant.

The invention is further directed to a method for protecting silver parts in an internal combustion engine by lubricating the same with a lubricant composition comprising a major proportion of an oil of lubricating viscosity and a minor amount of the above-described composition. In accordance with the present invention, the thiadiazole-containing lubricant composition provides excellent silver lubricity and obviates the need for chlorine-containing silver lubricity agents.

2. Discussion of the Prior Art

Large numbers of medium speed diesel engines in the United States, as well as other countries, utilize silver-plated bearings. Thus, apart from providing stability against oxidation and protection against the formation of sludge and carbonaceous deposits, crankcase lubricating oils intended for use in medium speed diesel engines must also be formulated with specialized silver protecting agents in order that silver parts in the engine are not attacked either by the additives in the oil or by the dispersed neutralized decomposition products produced during extended engine operation. Such agents, often referred to as silver lubricity agents, protect against extreme pressure, wear and corrosion.

Although it is essential to include a silver lubricity agent in diesel oils intended for use in engines having silver parts, it is well known that such oils must exclude the zinc-containing anti-wear agents mentioned above, such as the zinc dihydrocarbyldithiophosphates, given the known propensity of the latter to damage the silver components of diesel engines. This is explained, for example, in U.S. Pat. No. 4,428,850 (column 1, lines 63–68).

The antagonism between zinc-containing wear inhibitors and the silver parts in diesel engines has been circumvented in the prior art by using alternative silver lubricity compounds, by far the most common of which are the chlorinated hydrocarbons such as shown in Sung, U.S. Pat. No. 4,171,269. However, while the chlorine compounds of the prior art have been shown to be effective in protecting the silver parts of diesel engines, the Occupational Safety and Health Administration in the United States and other public health agencies throughout the world have expressed concern over potential biological effects of chlorinated compounds. Therefore, an incentive exists to develop novel compositions effective in protecting the silver parts of medium speed diesel engines which overcome the problems or potential problems encountered with the zinc-containing and chlorine-containing wear inhibitors.

Unfortunately, overbased alkali and alkaline earth metal detergents, added to provide beneficial cleanliness properties to lubricant formulations are the principal cause of damage to silver parts. Thus, while it is desirable to impart a high degree of alkalinity through the use of overbased detergents, such overbased materials tend to impair the silver protection characteristics of the oil, making it difficult, without resort to the chlorine-containing agents of the prior art, to formulate a diesel lubricant composition which gives the desired level of cleanliness, yet at the same time protects the silver parts of the diesel engine.

A number of patents are thought to be of relevance as background to the compositions and methods described in the present invention, for example, Sung, et al., U.S. Pat. No. 4,256,595, is directed to a diesel crankcase lubricant composition comprising a lubricating oil base and the reaction product of a hydrocarbyl succinic anhydride in which the hydrocarbyl radical has from 12 to 30 carbon atoms, and 5-aminotriazole. Although the background section of the patent states that it is known to employ a thiadiazole as a corrosion inhibitor for diesel crankcase lubricating oil, the use of a thiadiazole compound as the sole silver lubricity agent in lubricating oils requiring such agents for the protection of silver bearings is not disclosed.

Davis, U.S. Pat. No. 4,136,043, is directed to compositions useful for suppression of copper activity and "lead paint" deposition in lubricants. The compositions are produced by preparing a mixture of an oil soluble dispersant (preferably a substantially neutral or acidic carboxylic dispersant) and a dimercaptothiadiazole, preferably 2,5-dimercapto-1,3,4-thiadiazole. As stated at column 4, lines 24–39, the carboxylic dispersants encompass nitrogen bridged dispersants wherein the nitrogen group is derived from aliphatic, aromatic, heterocyclic and carbocyclic amines as well as substituted ureas, thioureas, hydrozines, guanidines, amidines, amides, thioamides, cyanamides and the like. Davis is not relevant to the problem of achieving silver lubricity in lubricating compositions for diesel engines.

Sung et al., U.S. Pat. No. 3,969,235 discloses a lubricating oil composition suitable for use in railway diesel engines in which thiadiazoles can be included as antioxidants, sulfur scavengers and antiwear agents (column 5, lines 16 to 24). Silver lubricity is not addressed in the patent and there is neither disclosed or suggested a chlorine-free lubricant composition in which thiadiazoles can completely replace the chlorine-containing silver lubricity agents of the prior art.

Roberts et al., U.S. Pat. No. 2,703,785 discloses an oil soluble 2,5-dimercapto-1,3,4-thiadiazole in an emulsifiable oil solution also containing an alkali metal salt of an oil soluble sulfonic acid. The patent is not directed to silver lubricity attainment in overbased detergent-containing formulations suitable for use in lubricant oils for diesel engines containing silver bearings.

Blaha U.S. Pat. No. 3,663,561 discloses (column 6, lines 27–36) that 2-mercapto-5-hydrocarbyldithio-1,3,4-thiadiazoles can be added to lubricating compositions to protect sliver metal parts from sulfur corrosion and to provide anti-wear. The patent does not, however, disclose a zinc-free, chlorine-free overbased detergent containing composition compatible with silver engine parts in higher TBN diesel engine applications.

Sabol U.S. Pat. No. 2,749,311 discloses compositions noncorrosive to silver comprising the reaction product of a mercaptan, formic acid and 2,5-di-mercapto-1,3,4-thiadiazole.

SUMMARY OF THE INVENTION

In view of the problems cited earlier, a general object of the present invention is to provide a silver protective lubricant additive composition.

A further object of the invention is to provide a silver protective lubricant additive composition suitable for addition to lubricant compositions used to lubricate the moving parts of medium speed diesel engines such as found in railway locomotives, marine towboats and stationary power applications.

Another object of the invention is to provide a silver lubricity additive composition suitable for addition to lubricating compositions used to lubricate the moving parts of medium speed diesel engines, which additive composition provides enhanced protection against silver wear, corrosion and extreme pressure.

Yet another object of the present invention is to provide a silver protective lubricant composition having a TBN of at least 7, and preferably 10 to 30, comprising overbased alkali or alkaline earth metal detergents which composition does not derive its silver lubricity characteristics from chlorinated silver lubricity agents. Other objects appear hereinafter.

We have now found that the foregoing objects are provided for in the present invention, namely, a lubricating composition having a TBN of at least 7 and preferably in the range of from about 10 to about 30, essentially free of zinc-containing wear inhibitor compounds and chlorine-containing silver lubricity agents, comprising: a major proportion of an oil of lubricating viscosity and a minor amount of (1) a thiadiazole compound having the general formula:

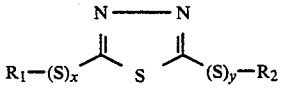

where x and y (being the same or different) are integers from 1 to 5 and $R_1$ and $R_2$ (being the same or different) are H or $C_1$ to $C_{50}$ hydrocarbyl; (2) an overbased detergent preferably selected from the group consisting of alkali and alkaline earth metal sulfonates, phenates and salicylates; and (3) an ashless dispersant.

As a method, the invention is directed to the protection of silver engine parts in an internal combustion engine by lubrication thereof with the above-described lubricating composition.

A primary advantage in the lubricating composition and method of the present invention, particularly in the context of medium speed railway diesel engines, is the fact that such agents are surprisingly effective in terms of silver lubricity characteristics, despite the absence of chlorine-containing silver lubricity agents mentioned earlier which, heretofore, have been virtually a staple additive in the prior art for silver lubricity attainment. The most frequently used such chlorine-containing agents are the chlorinated paraffins exemplified by the commercial product "Chlorowax" supplied by Keil Chemical Company of Hammond, Ind.

DETAILED DESCRIPTION

The thiadiazole compositions contemplated for use in the present invention comprise the 2,5-dimercapto-1,3,4 thiadiazole, the 2-mercapto-5-hydrocarbyldithio-1,3,4-thiadiazole, the 2,5-bis(hydrocarbyldithio)-1,3,4-thiadiazole, the 2-mercapto-5-hydrocarbylthio-1,3,4-thiadiazole, and the 2,5-bis(dihydrocarbylthio0-1,3,4-thiadiazole, and mixtures thereof. These compounds have the structural formulas shown below:

2,5-dimercapto-1,3,4-thiadiazole

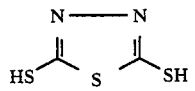

2-mercapto-5-hydrocarbylthio-1,3,4-thiadiazole

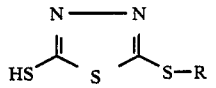

2,5-bis(hydrocarbylthio)-1,3,4-thiadiazole

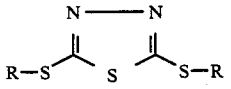

2-mercapto-5-hydrocarbyldithio-1,3,4-thiadiazole

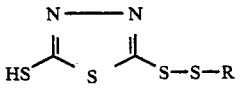

2,5-bis(hydrocarbyldithio)-1,3,4thiadiazole

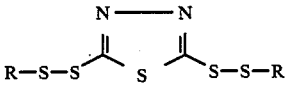

A particularly preferred 1,3,4-thiadiazole composition for use in the present invention is a mixture of from about 10 to about 50 wt. % 2-mercapto-5-hydrocarbyldithio-1,3,4-thiadiazole and from about 50 to about 90 wt. % 2,5-bis (hydrocarbyldithio)-1,3,4-thiadiazole where the hydrocarbyl substituents of the thiadiazole are $C_1$ to $C_{30}$ alkyl. Most preferably, the hydrocarbyl moiety is selected from the group consisting of heptyl, octyl, nonyl, decyl, undecyl, dodecyl, cetyl and isomers thereof.

The 1,3,4-thiadiazole compounds, or mixtures thereof, contemplated for use in the present invention can be readily obtained from commercial sources, such as the Amoco Petroleum Additives Company, or can be synthesized from hydrazine and carbon disulfide in a well-known manner. Particularly preferred for use in the invention are thiadiazole compositions commercially available from the Amoco Petroleum Additives Company under the trade names "Amoco-153" and "Amoco-158". U.S. Pat. Nos. 2,703,785; 2,719,125; 2,850,453; 3,663,561; 3,840,549 and 4,136,043 may be referred to for procedures on the preparation of the 1,3,4-thiadiazole compounds contemplated for use in lubricating compositions of the present invention. These patents are incorporated by reference herein.

The lubricating compositions of the present invention have a TBN of about 10–30, are essentially free of zinc and chlorine-containing compounds and comprise a major amount of an oil of lubricating viscosity and a minor amount of (1) a 1,3,4-thiadiazole as defined earlier; (2) an overbased detergent being preferably at least one member selected from the group consisting of alkali and alkaline earth metal sulfonates, phenates and salicylates; and (3) an ashless dispersant.

The oil of lubricating viscosity suitable for use in preparing the lubricant compositions of the present inventions can be of synthetic, animal, vegetable or mineral origin. Ordinarily, mineral lubricating oils are used by reason of their availability, general excellence, and low cost. Normally, the lubricating oils preferred will be fluid oils, ranging in viscosity of about 40 Saybolt universal seconds at 100° Fahrenheit to about 200 Saybolt universal seconds at 210° Fahrenheit. The preferred lubricant oil for use in the compositions of the present invention is a mineral base oil. The mineral base oil can be a blend of lubricant oils having viscosities such that the final viscosity at 100° Centigrade of the lubricating oil composition is preferably in the range of about 12.0 to 17.0 CSt. Thus, the suitable base lubricant mineral oil is selected to conform to viscosity requirements. The mineral base oil used to prepare the lubricating composition of the present invention preferably comprises a major portion, i.e., at least about 70 percent, and still more preferably, at least about 85 percent, by weight of the total composition.

A minor amount of thiadiazole preferred for use in the present invention which is sufficient to provide silver protection in the lubricating compositions of the present invention is an amount that is within the range of about 0.001 wt. % to about 10 wt. %, based on the weight of the lubricating oil composition. Preferably, the amount is within the range of about 0.01 wt. % to about 1.0 wt. %, based on the weight of the lubricating oil composition. A minor amount of overbased detergent is about 1 to about 20 wt. % of the lubricant composition. A minor amount of ashless dispersant in the lubricating composition is about 1 to about 10 wt. % thereof using a 40 to 50% active dispersant-in-oil solution.

Any ashless dispersant can be used in the present invention. A useful discussion of the chemistry and preparation of ashless dispersants can be found in U.S. Pat. No. 4,136,043 (beginning at column 2, line 54), incorporated by reference.

A preferred class of oil-soluble dispersants suitable for incorporation in the lubricating compositions of the present invention are the Mannich dispersants obtained from the condensation under Mannich reaction conditions of a hydroxyaromatic compound, aldehyde-yielding reagent, and an amine. Preferred Mannich reactants are: (a) a high molecular weight alkyl-substituted hydroxyaromatic whose alkyl substituent has a number average molecular weight of about 600–100,000, preferably a polyalkylphenol whose polyalkyl substituent is derived from 1-mono-olefin polymers (preferably polybutene) having an Mn of about 850–2,500; (b) an amine containing at least one primary or secondary —NH group, preferably an alkylene polyamine selected from the group consisting of diethylenetriamine, triethylenetetraamine, tetraethylenepentaamine, or mixtures thereof; and (c) an aldehyde, preferably formaldehyde, paraformaldehyde or formalin. The preparation of Mannich base dispersants (borated and non-borated) is disclosed in Piasek, et al., U.S. Pat. Nos. 3,697,574; 3,703,536; 3,704,308; 3,751,365; 3,756,953; 3,798,165; 3,798,247; and 3,803,039, all of which are incorporated herein by reference.

A further class of oil-soluble dispersants suitable for incorporation in the lubricating compositions of the present invention are the carboxylic polyamine dispersants, more frequently termed "succinimides," given that the most prevalently used dispersant in this class is the reaction product of an alkenyl-substituted succinic acid or anhydride with a nitrogen-containing compound. The succinic dispersants that can be used in the present invention are disclosed in numerous references and have become exceedingly well known in the art. Examples are taught in U.S. Pat. Nos. 3,172,892; 3,219,666; and 3,272,746. If desired, borated succinic dispersants can also be used. See for example, U.S. Pat. Nos. 3,087,936 and 3,254,025. A preferred succinic dispersant for use in the present invention is the reaction product of a polybutenyl succinic anhydride, wherein the polybutenyl group has a number average molecular weight between about 600 and 5,000, and the polyethylenepolyamine is selected from the group consisting of diethylenetriamine, triethylenetetraamine, tetraethylenepentaamine, and mixtures thereof.

Another class of dispersants suitable for use in the present invention is the succinate ester-amide dispersants, the latter term denoting the reaction product a long-chain aliphatic hydrocarbyl-substituted succinic acid or anhydride with an N-substituted hydroxyalkylamine. Representative patents disclosing this type of ashless dispersant are Malec, U.S. Pat. No. 4,426,305; and LeSeur, U.S. Pat. Nos. 3,219,666, 3,640,904 and 3,282,955, all of which are incorporated by reference. Preferred succinate ester-amide dispersants suitable for use in the lubricating compositions of the present invention are prepared by reacting a polybutenyl succinic acid composition and an alkylene diamine, preferably hexamethylenediamine, said alkylene diamine having an average of at least about 2.5 N-hydroxyalkyl groups. If desired, the succinate ester-amides can be borated with boron oxide, boron dihalides, boron acids, etc.

Yet another class of dispersants suitable for use in the present invention comprise the reaction products of aliphatic or alicyclic halides containing at least about 40 carbon atoms with amines, preferably, polyalkylene polyamines, examples of which dispersants are described in U.S. Pat. Nos. 3,275,554; 3,438,757; 3,454,555;

and 3,565,804; all of which are incorporated by reference.

Still another type of dispersant which can be used in the lubricating compositions of the present inventions are polymers containing an oil-solubilizing group, for example a pendant alkyl group having at least about 8 carbon atoms, and a polar group, for example, interpolymers of decyl methacrylate, vinyl decyl ether, or a relatively high molecular weight olefin with aminoalkyl acrylates, aminoalkyl acrylamides, or poly-(oxyalkaline)-substituted alkyl acrylates, as well as copolymers of styrene, alkyl maleates, and maleic acid amides or imides respectively. Such polymers can generally be identified as polymeric polyamine dispersants and are exemplified in U.S. Pat. Nos. 3,329,658; 3,449,250; 3,519,565; 3,666,730; 3,687,849; and 3,702,300, all of which are incorporated by reference.

In addition to the ashless dispersants and 1,3,4-thiadiazoles described above, the lubricating compositions of the present invention also require an overbased detergent or detergents sufficient to provide a TBN (total base number) of at least about 7, and preferably, within the range of about 10 to about 30. For purposes of the present invention, an overbased detergent is one in which a normally oil-insoluble inorganic base is stably dispersed via conventional carbonation overbasing techniques in an oleophilic detergent composition in which the amount of stably dispersed base exceeds that required to neutralize acidic compounds present in the detergent composition. While any overbased detergent will suffice, preferred overbased detergents suitable for providing the required TBN in the additive composition of the present invention are overbased alkali or alkaline earth metal sulfonates, phenates and salicylates. The overbased sulfonates comprise basic metal salts of petroleum sulfonic acids or long-chain alkyl-substituted benzene sulfonic acids. The overbased phenates comprise basic salts of alkylphenols, alkylphenol sulfides, and alkylphenol-aldehyde condensation products. As is known in the art, a normal metal salt of an acid is a salt which contains the stoichiometric amount of metal required for the neutralization of the acidic group or groups present in the acid, while an overbased salt is a salt which contains more metal than is required to stoichiometrically neutralize the acidic group or groups present. While both normal and overbased sulfonates, phenates and salicylates provide detergent properties for lubricating oil compositions, the preferred overbased or superbasic or hyperbasic salts provide unusually high detergent power and, consequently, have a much greater capacity to neutralize acidic contaminants than do the normal sulfonates and phenates. Overbased sulfonate can be prepared by mixing a promoter, catalyst or solvent with a normal sulfonate and a larger excess of metallic base, followed by heating, carbonation and filtration. Carbonation of the reaction mass, accomplished conveniently with carbon dioxide, is employed to increase the amount of metal base colloidally dispersed as metal carbonate in the filtered product. Phenols, trioacids of phosphorous, alcoholates, alcohols, ketones, and alkanolamines can be used as promoters for catalysts. Typical metallic bases are basic compounds of alkaline earth metals, such as calcium, barium or magnesium. Overbased metal sulfonates are discussed thoroughly in the prior art. Examples of such art are: U.S. Pat. Nos. 2,865,956; 2,956,018; 2,671,430; 3,779,920; 3,907,691; 4,137,184; 4,261,840; and 4,326,972. The overbased metal phenates are described in U.S. Pat. Nos. 2,680,096; 3,036,917; 3,178,368; 3,194,761; 3,437,595; 3,464,910; 3,779,920; and 4,518,807. All of the patents mentioned here are incorporated by reference. Numerous references also disclose methods of preparation for overbased salicylates.

A preferred lubricating composition embodying the present invention is essentially free of chlorine- and zinc-containing compounds, has a TBN of at least 7 and comprises: (1) a major amount of an oil of lubricating viscosity; (2) from about 0.05 to about 1.0 weight percent of the above thiadiazole compound; (2) from about 1 percent to about 10 weight percent of an ashless dispersant compound containing from about 40 weight percent to about 50 weight percent active component and selected from the group consisting of Mannich base dispersants, succinic dispersants, and succinate ester-amide dispersants; (3) from about 1 to about 20 weight percent alkali or alkaline earth metal detergent compositions to provide alkalinity reserve, oxidation inhibition and detergency to the lubricating oil composition, said alkaline earth metal compositions being selected from the group consisting of calcium alkylsulfonates, magnesium alkylsulfonates, sodium alkylsulfonates, calcium alkylphenolates, magnesium alkylphenolates, calcium alkylsalicylates, magnesium alkylsalicylates, and mixtures thereof.

A particularly preferred embodiment of the present invention is a zinc- and chlorine-free lubricant composition comprising (1) a major proportion of mineral oil of lubricating viscosity; (2) a Mannich dispersant comprising the reaction product of alkylphenol, a polyamine and formaldehyde; (3) an alkaline earth metal salt of a Mannich condensation reaction product comprising the reaction product of alkylphenol, formaldehyde and a polyamine; (4) an alkylbenzene sulfonate of an alkaline earth metal; (5) an overbased alkaline earth metal sulfurized phenate; (6) 1,3,4-thiadiazole and (7) a small amount of a foam inhibitor.

The above embodiments can be prepared by suspending or dissolving in the mineral oil various additives. The mineral oil used can be selected to conform to viscosity requirements. Either a single base oil or blends of different viscosity base oils may be used as the base oil for the additive lubricant oil. The components may be blended in any order and in any combination. The first component of the preferred lubricant composition is the ashless dispersant, i.e., the Mannich condensation reaction obtained by reacting a polyalkylphenol, a polyamine and formaldehyde. The alkylphenol is commonly a high molecular weight alkyl-substituted hydroxyaromatic compound such as polypropyl phenol, polybutyl phenol or other alkylphenols. These alkylphenols may be obtained by the alkylation of phenol in the presence of an alkylating catalyst such as $BF_3$—HF, $BF_3$ or $AlCl_3$ with high molecular weight polypropene, polybutene or other polyalkene compounds to give alkyl substituents on the benzene ring of the phenol having a number average molecular weight of from about 600 to about 100,000. These alkyl-substituted hydroxyaromatic compounds may be derived from polypropenes, polybutenes and other polymers of monoolefins, principally 1-butene, 2-butene, isobutene and propene. Also, monomers may be copolymerized with propene or butene and other chlorinated, brominated or other derivatives of monoalkene compounds. The Mannich products may also contain fatty acids. The fatty acids compounds are thought to promote ease of production of the additives. The fatty acids also increase the detergency, the dispersancy and deposit preventing properties of the Mannich dispersants. Fatty acids such as oleic, linoleic, stearic and other $C_{16}$ to $C_{24}$ acids are suitable. Oleic acid is generally preferred. Preferably, the configuration of the alkyl-substituted hydroxyaromatic compound is that of para-alkylphenol. However, other alkylphenols are relatively reactive and thus useful in preparation of the Mannich dispersant. Representative amine reactants for use in preparing the Mannich dispersant preferred for use in the present invention are alkane polyamine, principally, polyethylene polyamines. Examples of polyamines which are useful are ethylamine, diethylamine, dimethylamine or propylamine; ethylenediamine, diethylenetriamine, triethylenetetraamine, tetraethylene pentaamine, pentaethylenehexamine, etc., and mixtures thereof. Representative aldehydes for use in preparing the Mannich dispersant include paraformaldehyde, formalin, acetaldehyde, and betahydroxybutyraldehyde. Preferably a formaldehyde or formaldehyde-yielding reactant is used.

Component (3) prescribed for use in the preferred embodiment of the present invention is a low or high base alkylbenzene sulfonate. Such overbased alkylsulfonate is preferably produced from alkylated benzene sulfonic acid. The alkylated benzene sulfonic acid is generally produced by sulfonating benzene alkylates. The broad class of benzene alkylates include such compounds as polypropylbenzene, polybutylbenzene, polyisobutylbenzene, poly-2-butylbenzene, polyethylenebenzene and copolymers of propyl and 1-butylbenzene and other various copolymers of ethylene, propene and butene isomers. The preferred alkylbenzenes are polypropyl, polybutyl and copolymer propyl butylbenzenes. Especially preferred are polypropylbenzenes wherein the alkyl moiety has a number average molecular weight of from about 400 to about 1,000. The alkaline metal salt which is used to overbase the alkylsulfonic acids may be chosen from a group consisting of barium oxide, calcium oxide, calcium hydroxide magnesium oxide or other group 1 and 2 metal bases. Preferably, the overbased sulfonic acids are produced from calcium oxide. The alkylbenzenes are commonly sulfonated with fuming sulfuric acid or oleum, in standard industrial sulfonation procedures. The sulfonate is overbased when the sulfonate contains more base than is needed to neutralize the sulfonic acid. Degrees of overbasing are measured in the form of total base number by ASTM D-2896. Total base number is equivalent to the milligrams of KOH equivalent to the amount of base in the composition which exceeds the amount needed to neutralize the sulfonic acids. TBN's of 1–400 are common.

Component (4) prescribed for use in the preferred embodiment of the present invention is the alkaline earth salt of an alkylphenol, formaldehyde, polyamine Mannich reaction product, preferably the calcium Mannich phenate. Phenols which have utility in this application are the alkylated phenols such as methyl, ethyl, propyl, butyl, pentyl, hexyl, heptyl, octyl, nonyl, decyl, undecyl, dodecyl, phenyl and the like. Also useful are alkylated phenols such as polyalkyl phenols formed from polyalkylenes and phenols. Formaldehyde may be in the form of paraformaldehydes formalin or other well-known formaldehyde reactants. Polyamines such as ethylenediamine, diethylenetriamine, and tetraethylenepentaamine find hw utility in preparation of the calcium Mannich phenate. The Mannich condensation reaction product is overbased using an alkaline earth metal salt containing calcium, barium or magnesium to obtain a TBN of from about 1 to about 170. The metal may be in the form of oxides or hydroxides or carbonates. The preferred alkaline earth metal is calcium.

Component (5) prescribed for use in the preferred embodiment of the present invention is an overbased alkaline earth metal sulfurized alkylphenate sulfide used as an alkalinity agent/detergent. Alkylphenols such as decyl, nonyl, octyl or other phenols can be alkylated using polyalkylenes in a well-known manner. The alkylphenols react with an alkali or alkaline earth metal such as sodium, calcium or magnesium to form a metal salt of an alkylphenate. Preparation of a sulfurized alkylphenol using elemental sulfur can be carried out using conventional techniques. TBN's from about 1 to about 300 may be obtained. A preferred alkaline earth metal salt of a sulfurized alkylphenate in the present invention is the high base sulfurized calcium phenate detergent available from the Amoco Petroleum Additives Company under the trade name "Amoco-9213".

Component (6) for use in the preferred embodiment of the present invention comprises the silver protective 1,3,4-thiadiazole.

Finally, Component (7) is preferably a silicon antifoam agent commonly used in the art and generally identified as a polydimethylsiloxane. The typically properties at 77° F. are viscosity in the range of about 10 to about 100,000 centistokes, pour point of about 40° F. to about 60° F., specific gravity of about 0.900 to about 0.995.

While it has been stated that additional additive agents may be incorporated in the lubricating compositions of the present invention, it is important that the lubricant composition of the present invention exclude zinc-containing wear agents if the lubricating compositions are used in diesel engines containing silver parts. This exclusion is intended to exclude amounts of zinc-containing wear inhibitors such as the zinc dihydrocarbyl dithiophosphate compounds sufficient to exert a measurable deleterious effect upon silver parts. At lesser amounts having no measurable effect, the lubricant is considered "essentially free" of zinc compounds for purposes of the present invention. If used in other engine environments which do not contain silver parts, the additives of the present invention can provide useful lubricity, wear, and anti-corrosion properties and may be used in conjunction with zinc compounds.

Insofar as the present invention is based upon the identification of substitutes for chlorine-containing silver lubricity agents, such as chlorinated paraffins, the present invention excludes such agents. Such exclusion is intended to cover amounts of chlorine-containing silver lubricity agents capable of exerting a detectable (i.e., measurable) benefit in terms of silver protection. At lesser amounts, a lubricant composition is deemed, for purposes of the present invention, to be "essentially free" of chlorine containing agents.

EXAMPLE

The following formulation (TBN 13) was tested in the two cylinder EMD2-567 fired engine test measuring silver lubricity.

| Component | Wt. % |
|---|---|
| Mannich Dispersant | 3.3 |
| Calcium Mannich Phenate | 4.8 |

-continued

| Component | Wt. % |
|---|---|
| Calcium Sulfonate | 2.0 |
| Calcium Sulfurized Phenate | 1.65 |
| Silver Lubricity Agent | (see below) |
| Base Oil | remainder |

Test duration was 24 hours at 208 horsepower load and 835 rpm following an initial nine hour stepwise break-in period. At the end of the test, the two silver plated piston insert bearings are rated using a system of demerits corresponding to the amount of silver displaced on the surface of the bearing by the rocking motion of the insert pin. Demerit totals less than 40 on each bearing are considered a passing test.

In Case I below, the formulation was tested with 0.5 wt. % chlorowax 40 as the silver lubricity agent; in Case II, 0.5 wt. % of a partial fatty acid ester silver lubricity additive was present; and in Case III, the formulation was tested with 0.05 wt. % 1,3,4-thiadiazole composition available from Amoco Petroleum Additives Company under the tradename "Amoco 158" as the sole silver lubricity agent. The results are set forth below:

| | EMD 2-567 TEST RESULTS | | |
|---|---|---|---|
| Demerits | Case I | Case II | Case III |
| Left | 17.5 | 61.3 | 21.3 |
| Right | 12 | 8.8 | 19.5 |
| Average | 14.75 | 35.5 | 20.4 |

We claim:

1. A lubricating composition having a TBN of at least about 7, which is essentially free of zinc or chlorine-containing compounds, comprising: a major proportion of an oil of lubricating viscosity and a minor amount of (1) a thiadiazole compound having the general formula:

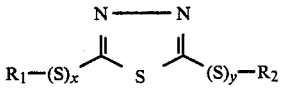

wherein x and y, being the same or different, are integers from 1 to 5, and $R_1$ and $R_2$, being the same or different, are H, or $C_1$ to $C_{50}$ hydrocarbyl; (2) an overbased detergent; and (3) an ashless dispersant.

2. The lubricant composition of claim 1 having a TBN of about 10 to about 30 wherein the thiadiazole is at least one member selected from the group consisting of 2,5-dimercapto-1,3,4-thiadiazole; 2-mercapto-5-hydrocarbyldithio-1,3,4-thiadiazole; 2,5-bis(hydrocarbyldithio)-1,3,4-thiadiazole; -2-mercapto-5hydrocarbylthio-1,3,4-thiadiazole; and 2,5-bis(dihydrocarbylthio)-1,3,4-thiadiazole where the hydrocarbyl group is $C_1$ to $C_{30}$ alkyl and the overbased detergent is at least one member selected from the group consisting of alkali or alkaline earth metal sulfonates, phenates and salicylates.

3. The lubricant composition of claim 2 wherein the ashless dispersant is selected from the group consisting of Mannich base, succinimide, and succinate ester-amide dispersants.

4. The lubricant composition of claim 3 comprising an overbased alkali or alkaline earth metal phenate.

5. The lubricating composition of claim 4 wherein the dispersant is Mannich base and the overbased phenate is a calcium sulfurized phenate.

6. The lubricating composition of claim 5 wherein the thiadiazole is a mixture comprising from about 10 to about 50 wt. % 2-mercapto-5-hydrocarbyldithio-1,3,4-thiadiazole and from about 50 to about 90 wt. % 2,5-bis(hydrocarbyldithio)-1,3,4-thiadiazole.

7. The lubricating composition of claim 5 wherein the hydrocarbyl moieties are $C_1$ to $C_{30}$ alkyl.

8. The lubricating composition of claim 7 wherein the hydrocarbyl moieties are selected from the group consisting of heptyl, octyl, nonyl, decyl, undecyl, dodecyl, cetyl and isomers thereof.

9. A method for protecting silver parts in an internal combustion engine which method comprises the step of contacting the internal portion of said engine with a lubricating composition having a TBN of at least about 7, which is essentially free of zinc or chlorine-containing compounds, comprising: a major proportion of an oil of lubricating viscosity and a minor amount of (1) a thiadiazole compound having the general formula:

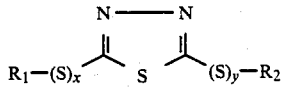

wherein x and y, being the same or different, are integers from 1 to 5 and $R_1$ and $R_2$ being the same or different, are H, or $C_1$ to $C_{50}$ hydrocarbyl; (2) an overbased detergent; and an ashless dispersant.

10. The method of claim 9 wherein the lubricating composition has a TBN of about 10 to about 30 and wherein the thiadiazole is at least one member selected from the group consisting of 2,5-dimercapto-1,3,4-thiadiazole; 2-mercapto-5-hydrocarbyldithio-1,3,4-thiadiazole; 2,5-bis(hydrocarbyldithio)-1,3,4-thiadiazole; and 2-mercapto-5-hydrocarbylthio-1,3,4-thiadiazole where the hydrocarbyl group is $C_1$ to $C_{30}$ alkyl and the overbased detergent is at least one member selected from the group consisting of alkali or alkaline earth metal sulfonates, phenates and salicylates.

11. The method of claim 10 wherein the ashless dispersant is selected from the group consisting of Mannich base, succinimide, and succinate ester-amide dispersants.

12. The method of claim 11 comprising an overbased alkali or alkaline earth metal phenate.

13. The method of claim 12 wherein the dispersant is Mannich base and the overbased phenate is a calcium sulfurized phenate.

14. The method of claim 13 wherein the thiadiazole is a mixture comprising from about 10 to about 50 wt. % 2-mercapto-5-hydrocarbyldithio-1,3,4-thiadiazole and from about 50 to about 90 wt. % 2,5-bis(hydrocarbyldithio)-1,3,4-thiadiazole.

15. The method of claim 14 wherein the hydrocarbyl moieties are $C_1$ to $C_{30}$ alkyl.

16. The method of claim 15 wherein the hydrocarbyl moieties are selected from the group consisting of heptyl, octyl, nonyl, decyl, undecyl, dodecyl, cetyl and isomers thereof.

* * * * *